United States Patent [19]

Beck

[11] 4,140,227

[45] Feb. 20, 1979

[54] CABLE WAY APPARATUS FOR TRANSPORTING PIPE

[76] Inventor: Don D. Beck, Box 1369, Odessa, Tex. 79760

[21] Appl. No.: 733,112

[22] Filed: Oct. 18, 1976

Related U.S. Application Data

[63] Continuation of Ser. No. 327,423, Jan. 29, 1973, abandoned, which is a continuation-in-part of Ser. No. 173,861, Aug. 23, 1971, Pat. No. 3,713,547.

[51] Int. Cl.[2] ..... E21B 19/14

[52] U.S. Cl. ..... 214/2.5; 104/112; 175/85; 212/76; 214/1 P

[58] Field of Search ..... 214/2.5, 1 P, 152, 12–15 R, 214/94; 212/72–123; 104/112–117; 175/52, 85

[56] References Cited

U.S. PATENT DOCUMENTS

| | | | |
|---|---|---|---|
| 597,904 | 1/1898 | Hallidig | 214/2 |
| 814,933 | 3/1906 | Bendickson | 104/112 X |
| 890,306 | 6/1908 | Schmertz | 214/2.5 X |
| 1,053,305 | 2/1913 | Leve | 212/72 |
| 2,371,887 | 3/1945 | Hamilton, Jr. | 212/77 X |
| 2,448,324 | 8/1948 | Pool | 214/2.5 |
| 2,999,605 | 9/1961 | De Jarnett | 214/2.5 |
| 3,774,780 | 11/1973 | Buffington | 214/2.5 |

FOREIGN PATENT DOCUMENTS

| | | | |
|---|---|---|---|
| 1189622 | 4/1970 | United Kingdom | 212/72 |

*Primary Examiner*—Frank E. Werner
*Attorney, Agent, or Firm*—Marcus L. Bates

[57] ABSTRACT

Method and apparatus for transporting pipe between spaced locations comprising a cable disposed in proximity of the two locations which supports a pipe receiving trough so that the trough can be moved by the cable to enable a pipe supported therein to be transported between the two locations. The tension in the cable is adjusted to enable the trough to be moved in a vertical plane. In one of the embodiments, the trough is directly attached to and moved with the cable. Longitudinal motion imparted into the cable causes the trough to move from one location to the other carrying the pipe therewith. The cable is slackened to vertically move the trough so as to enable the pipe to be placed within or removed from the trough. In another of the embodiments, the trough is attached to spaced carriages which are slidably supported from the cable. A pilot cable attached to the trough enables the trough to be moved longitudinally of the cable to enable transportation of the pipe between the spaced locations.

1 Claim, 24 Drawing Figures

FIG. 1
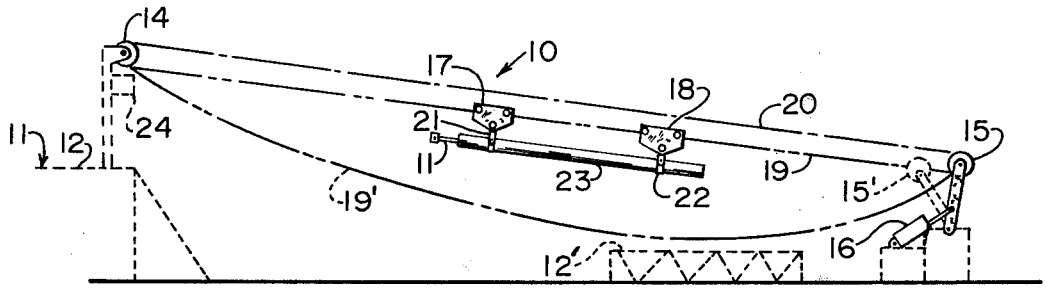
FIG. 2
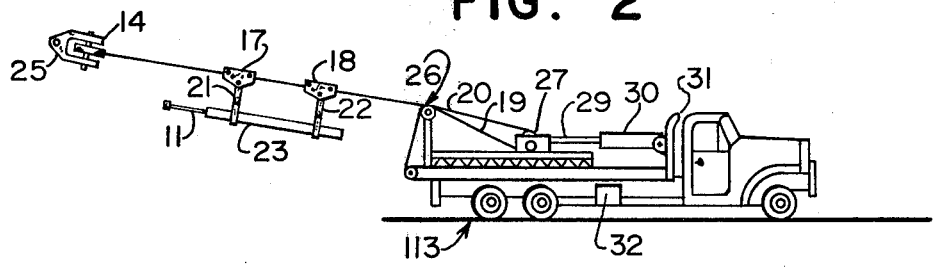
FIG. 3
FIG. 4
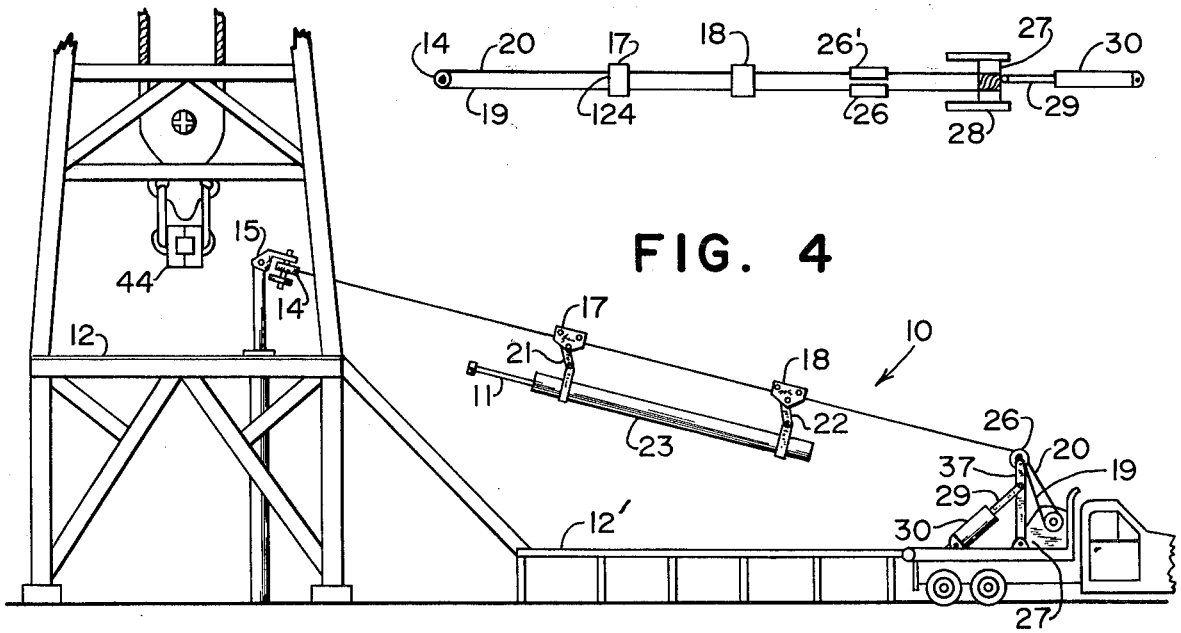

FIG. 8
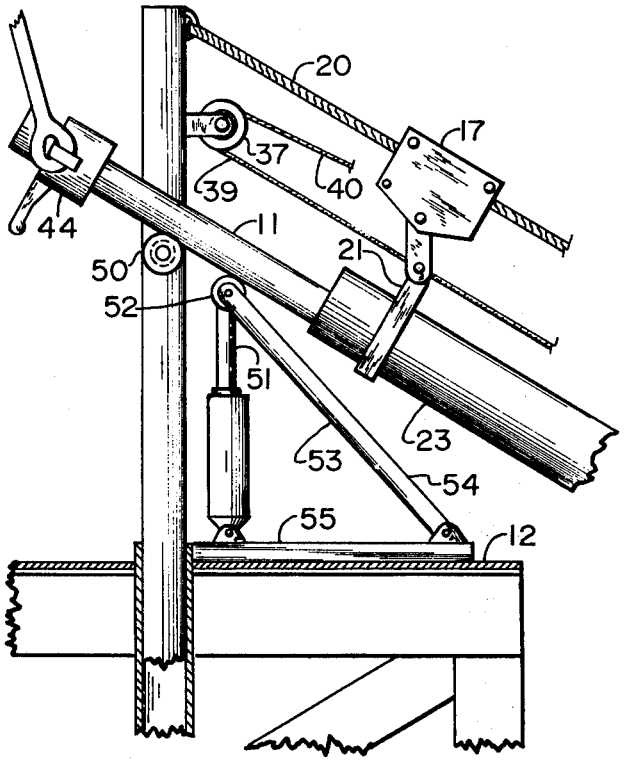
FIG. 9
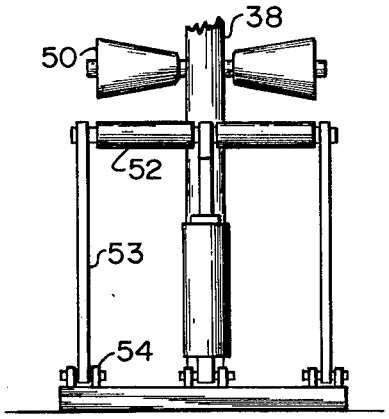
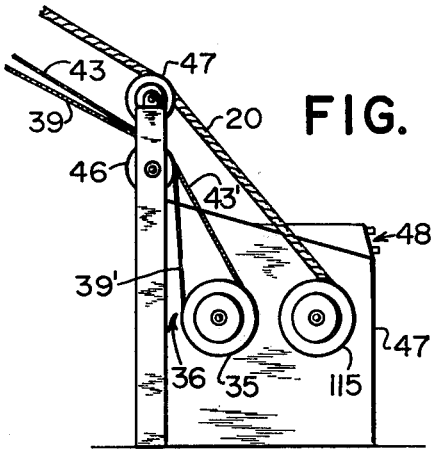
FIG. 10
FIG. 11a
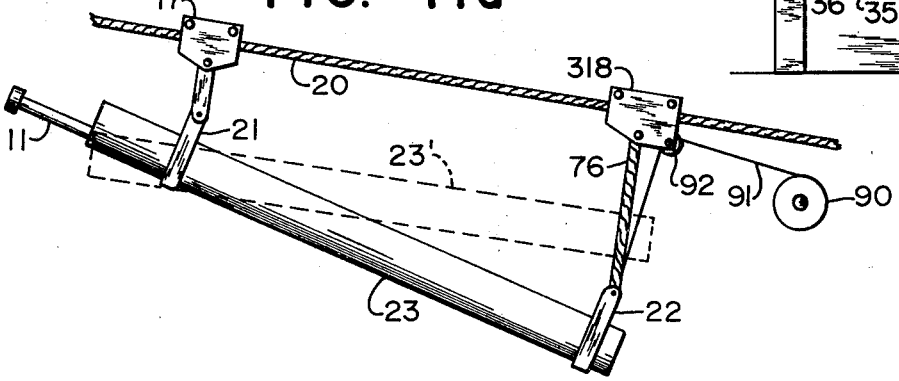
FIG. 11b
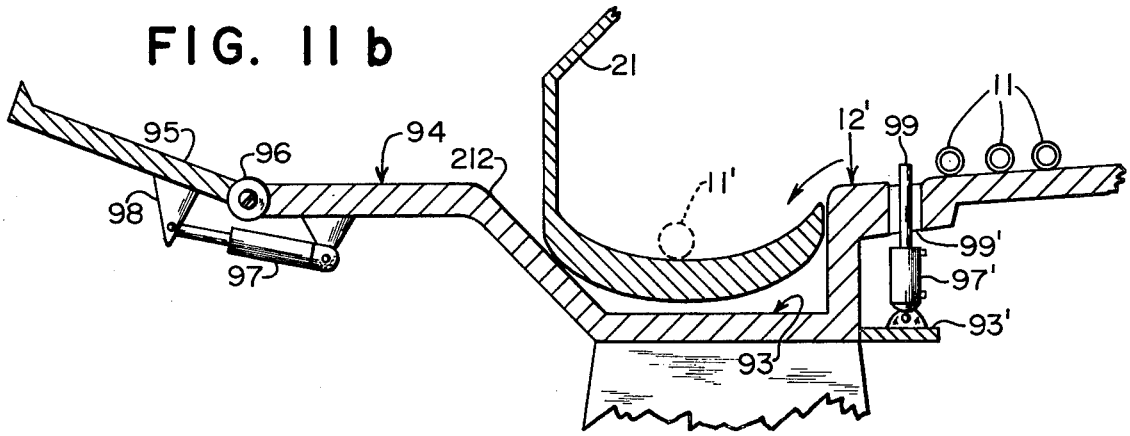

CABLE WAY APPARATUS FOR TRANSPORTING PIPE

This patent application is a continuation of application Ser. No. 327,423 filed Jan. 29, 1973, now abandoned, which was a continuation-in-part of patent application Ser. No. 173,861 filed Aug. 23, 1971 now U.S. Pat. No. 3,713,547 issued Jan. 30, 1973.

BACKGROUND OF THE INVENTION

Reference is made to my previously filed patent application, Ser. No. 17,768, filed Mar. 9, 1970, and Ser. No. 173,861, filed Aug. 23, 1971, now U.S. Pat. No. 3,713,547, of which this application is a continuation in part, for further background of the invention. In one of my previous referred to apparatus, a pilot cable is utilized for moving pipe carriages along a single main cable way. The various pilot cables and other secondary cables are sometimes found to be cumbersome and often lead to complex mechanisms in order to properly control the longitudinal movement of the trough along the cable way.

In another of my previous apparatus, an endless cable is employed to which spaced carriages are positioned, with one of the carriages being slidable along the cable and another of the carriages being affixed to the cable, so that movement of the cable imparts motion into one of the carriages and hence, into a pipe which has been placed within both of the carriages.

In both of the previous apparatus referred to above, the pipe is subjected to considerable abuse while it is being transported between the spaced locations. Considerable experience and skill is required of an operator in order that he might operate the equipment without endangering workmen, as well as avoiding damage to the pipe which is being transported. Accordingly, it would be desirable to provide improvements in the art of transporting pipe along a cable way which overcomes many of the defects of the prior art. Further, it is desirable to provide improvements in the prior art pipe handling apparatus which avoids the possibility of a pipe being inadvertently dropped during its trip between the rack and the rig floor.

SUMMARY OF THE INVENTION

This invention comprehends method and apparatus for transporting a pipe between spaced locations by the provision of a cable way disposed with at least part of the length thereof being positioned in overhanging relationship with respect to the spaced locations. A pipe placed within a pipe receiving trough is transported by moving the cable longitudinally along its length. The trough bottom-supports the pipe and is provided with upwardly and outwardly disposed openings to facilitate loading and unloading the pipe. A bulkhead, located at one end of the trough, abuttingly receives the end of the pipe thereagainst. The length of the trough relative to the pipe causes a marginal end portion of the pipe to freely depend from the outwardly opening end of the trough to thereby enable the pipe to be rapidly engaged by an elevator and easily removed from the trough. Means are provided for removing the pipe from the trough when the trough reaches the pipe rack.

In one embodiment of the invention, the tension in the cable is controlled by spooling some of the cable onto or off a drum so as to enable the cable to be slackened or tensioned to thereby vertically control the elevation of the trough relative to one of the locations.

In another embodiment of the invention, the tension in the cable is controlled by moving one of the pulleys towards the other so as to enable the cable to be slackened or tensioned to thereby vertically control the elevation of the trough relative to one of the locations.

This expedient enables pipe to be placed within the pipe receiving trough, the cable taughtened, and the trough then moved along the cable.

Accordingly, a primary object of the present invention is the provision of method and apparatus for transporting pipe along a cable way between a derrick floor and a pipe rack.

Another object of the invention is to provide apparatus for transporting pipe between geographically spaced apart locations by the utilization of a pipe receiving trough which moves along a cable with the cable overhanging each said location.

A further object of this invention is to provide an elevated cable way which enables the transportation of tubular goods between the derrick floor and the pipe rack.

A still further object of this invention is to provide improvements in method and apparatus for racking pipe associated with a borehole forming operation.

Another object of this invention is the provision of an endless cable for transporting pipe from one location to another.

Still another object of the present invention is to provide an endless cable having a pipe receiving trough disposed thereon which can be moved from one location to another by moving the cable longitudinally along its length.

A further object of this invention is the provision of a method of transporting tubular goods from a pipe rack to a derrick floor by disposing an endless cable upon spaced apart pulleys with a limited length of the cable being placed in close proximity of each of the locations so as to enable the movement of the cable to be utilized in transporting the pipe from one location to another.

These and various other objects and advantages of the invention will become readily apparent to those skilled in the art upon reading the following detailed description and claims and by referring to the accompanying drawings.

The above objects are attained in accordance with the present invention by the provision of a method of transporting pipe when using apparatus fabricated in a manner substantially as described in the above abstract and summary.

BRIEF DESCRIPTION OF THE DRAWINGS

FIG. 1 is a schematical representation which set forth a side elevational view of apparatus for transporting pipe from a pipe rack to a derrick floor;

FIG. 2 is an idealized side elevational view which diagrammatically sets forth another embodiment of the present invention;

FIG. 3 is a partial top plan view of the apparatus seen in FIG. 2, with some parts being removed therefrom;

FIG. 4 is a detailed, side elevational view of another embodiment of the apparatus made in accordance with the present invention;

FIG. 8 is an enlarged, broken view of part of the apparatus seen in the foregoing figures;

FIG. 9 is a rear view of the apparatus seen in FIG. 8, with some parts being removed therefrom so as to better disclose the invention;

FIG. 10 is a broken, side view of part of the apparatus disclosed in FIG. 2;

FIG. 11*a* is a modification of the apparatus disclosed in the foregoing figures;

FIG. 11*b* sets forth another modification of the trough seen disclosed in some of the foregoing figures;

DETAILED DESCRIPTION OF THE VARIOUS EMBODIMENTS

Figure 5:
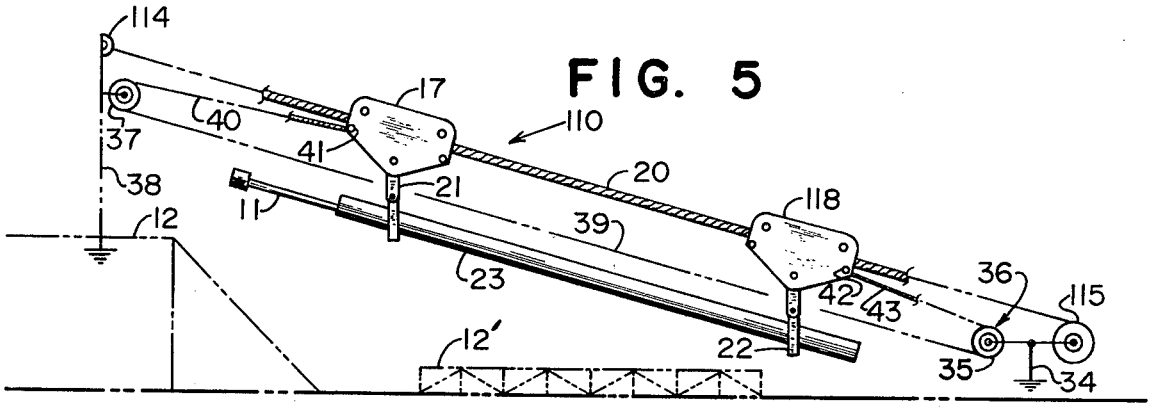
FIG. 5 is similar to FIG. 1 and sets forth a modification thereof.

In FIG. 1 the arrow at numeral 10 broadly indicates apparatus for transporting pipe between spaced locations, as for example, a derrick 11 having an elevated floor 12, and a pipe rack 12'. Numeral 13 indicates structure to which part of the apparatus can be anchored.

Spaced cable receiving pulleys, 14 and 15, are supported from the before mentioned structure. A hydraulically actuated cylinder 16 moves pulley 15 into the dot-dashed position 15'. The pulley 15 preferably is in the form of a drum having a prime mover attached thereto for imparting rotational motion thereinto. Spaced apart cable engaging members 17 and 18 are affixed to and supported by portion 19 of an endless cable. The endless cable is rove about the spaced apart pulleys with one portion or marginal length of the cable 20 remaining free of the cable engaging members.

Arms 21 and 22 are attached to the cable engaging members and support the opposed marginal end portions of a pipe receiving trough 23. Numeral 24 broadly illustrates a deflector plate which is set at an angle to the cable and deflects the uppermost end of the pipe from the structure which supports pulley 14.

In the embodiment of FIGS. 2 and 3, the cable engaging members are seen to be supported by both longitudinally extending portions, 19 and 20, of the cable. The pulley housing 25 is attached to structure which is spaced from a winch transporting truck 113. The two parallel portions of the cable are brought over a pair of pulleys at 26, 26', and rove about a cable drum 27. The drum is slidably captured within or upon rails 28 so that the drums can be moved towards and away from pulleys 26, 26', by means of the illustrated hydraulically actuated piston 29. The piston is reciprocatingly received within a cylinder 30 in the usual manner, while structure 31 pivotally anchors the free depending end of the cylinder. A hydraulic pump 32 provides a source of power for the cylinder and can be powered by means of a power take-off connected to the truck engine, if desired.

In the illustrated embodiment of FIG. 4, the upstanding member 37 has the spaced apart pulleys 26 attached to the free depending end thereof, with the lowermost end being pivotally attached forwardly of the cable drum. The free end of piston 29 is connected to an intermediate portion of member 37, with one end of the hydraulic cylinder 30 being pivotally attached to the bed of the truck.

Figure 6:
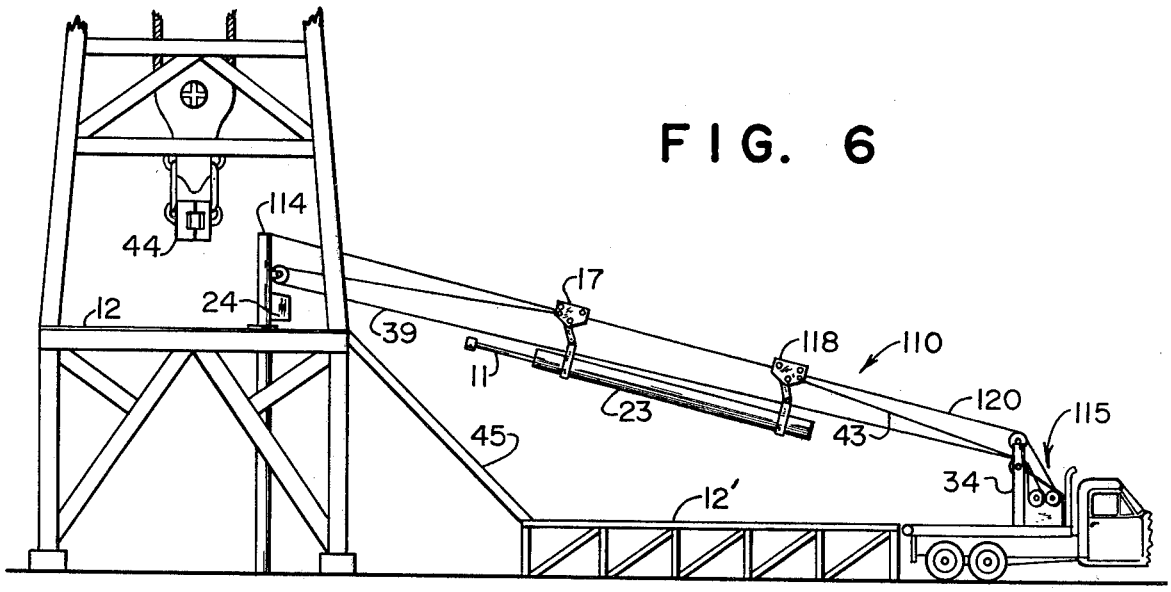
FIG. 6 is an enlarged, fragmentary, more detailed side view of apparatus made in accordance with the embodiment of the invention seen in the foregoing figure.
Figure 7:
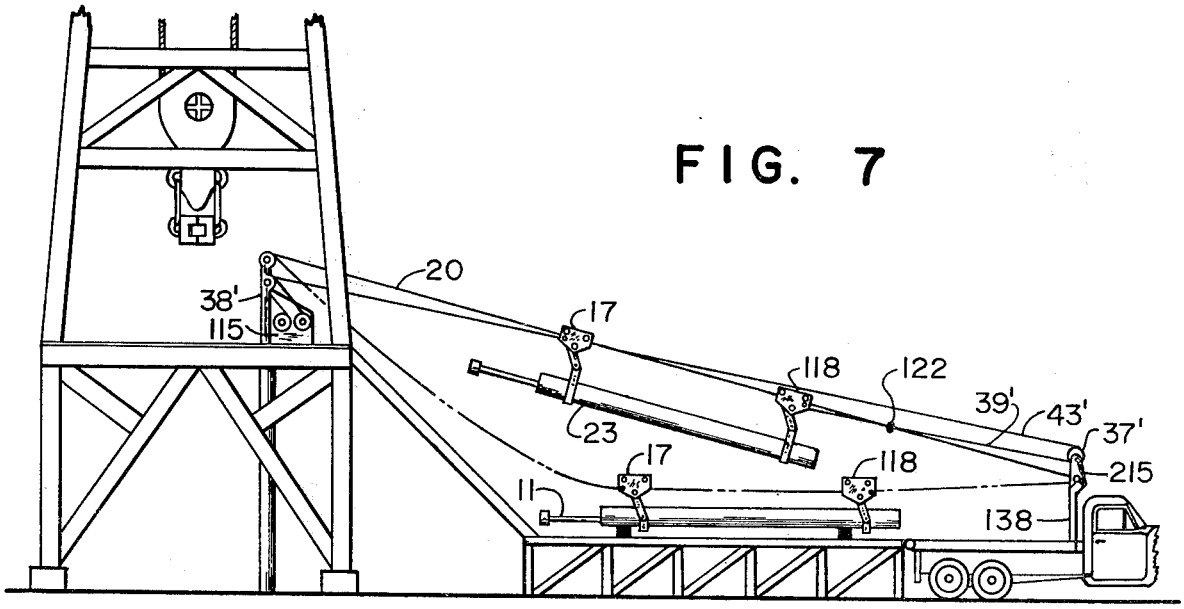
FIG. 7 is a side view of a modification of the apparatus disclosed in FIGS. 5 and 6.

Looking now to the details of FIGS. 5–7, and in particular to FIG. 5, the numeral 10 is intended to indicate in a schematical or diagrammatical manner an elevated cable-way having a portion thereof overlying a derrick floor 12 and a pipe rack 12'. Tubular goods 11 are transported between the floor and the rack. Spaced pipe receiving carriages 17 and 18 are slidably received for longitudinal movement along a first or main cable 20. The cable is suspended between vertical supporting structure 34 and 38.

Tensioning means 115, which can be in the form of a powered cable drum, is anchored to support 34 for controlling the vertical height of the cable which supports and guides the spaced apart carriages. Secondary cable drums 35 and 36, as well as sheave 37, are positioned out of the path of travel of the carriages and are affixed in journaled relationship to each of the respective support means. Attached to the lowermost carriage 118 are the illustrated cables 39, 40, and 43, with one cable 39, 40, being rove about pulley 37 and back to a drum 36, while another cable 43, attached to the lowermost carriage, is likewise attached to a drum 36 (not shown) located adjacent to drum 35.

Looking now in greater detail to the embodiment of the invention seen illustrated in FIG. 6, an elevator 44 is seen to be disposed in the usual manner above the derrick floor 12. A truck is positioned adjacent to the pipe rack 12. The truck is provided with the necessary motors and drums for controlling the action of the apparatus.

FIG. 7 discloses the power means and the drums for the apparatus as being located on the derrick floor, while the anchoring means 138 is disposed adjacent to the cab of the truck. Numeral 122 indicates a stop means for arresting motion of the lower carriage.

Looking now in greater detail to the various parts of the apparatus, and in particular to FIGS. 8 and 9, there is seen projecting through the derrick floor the before mentioned tubular member 38 which is suitably anchored to the rig structure as, for example, being placed in the mousehole provided in the floor so as to form an anchoring means for the cable-way. Spaced inwardly converging rollers, one of which is indicated by numeral 50, receive pipe 11 in low friction rolling relationship thereon, with the elevators 44 partially supporting one end of the pipe. Spaced apart from and underlying the tapered rollers there is disposed a hydraulic ram having piston 51 journaled to spaced rollers 52 and articulated by member 54, the extremities of which are journaled to the roller shaft and to a suitable fixed base 55.

As seen in FIG. 10, each of the pilot cables 39 and 43 are brought over adjacent pulleys, one of which is seen at 46, and oppositely wound about and connected to spaced drums, one of which is seen at 35 with the adjacent drum 36 being hidden from view. The spaced drums 35, 36 are independently movable with respect to one another, and may be releasibly connected to one another by a clutch means, if desired. The spaced drums at 115 and 35 are attached to conventional power units of a suitable size for tensioning cable 20 and for moving the loaded trough.

The details of the various embodiments of the trough are set forth in FIGS. 11*a*–21. As seen in the specific embodiment of FIGS. 11–14, pipe 11 is illustrated as being bottom supported within the upwardly and outwardly opening trough. Spaced hangers 21, 22, have one end rigidily affixed to a side wall of the trough, with the free apertured depending end adapted to be affixed to either a carriage or a cable engaging member. A short length of chain can be interposed between the hanger and the cable engaging member, if desired.

Means in the form of spaced arms 56 are provided for rotating the trough about the pipe so that the pipe is forced to roll therefrom by gravitational forces. The arms are affixed to a side wall of the trough in opposed relationship to the hangers and arranged at an angle so that an intermediate portion thereof intersects the center of gravity 59 of the trough, whereby the trough is forced into the illustrated progressive dumping configuration set forth in FIGS. 12–14. A rear vertical bulkhead 57 abuttingly receives the pin end of the pipe, while the outwardly opening end 58 of the trough permits a marginal box end of the pipe to freely extend therefrom. The center of gravity of the pipe must be positioned within the trough.

Figure 15:
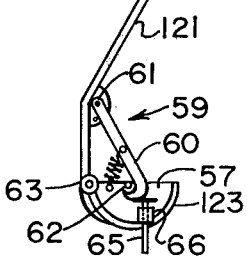
FIGS. 15 and 16 are rear elevational views of a modification of the apparatus seen in FIG. 11*c;*

In the embodiment of FIG. 15, rear bulkhead 57 and arm 121 are aligned with one another and provided with co-acting latch means. Latch 60 is pivoted to the hanger at 61 and releasibly engages pin 62, with the pin being affixed to and outwardly depending from bulkhead 57.

A longitudinally extending hinge means 63 hingidily connects the trough 123 to the hanger 121. A reciprocating trip 65, preferably square is cross-sections, is slidably received within a housing, preferably square in cross-section, or bushing 66, so that when the trough is set down, the trip member will engage a lower portion of the latch, thereby forcing the latch to move against the illustrated biasing means, releasing the latch from the pin and enabling the trough to pivot about hinge 63. Spring return means may be provided between the trough and the hanger, if desired.

Figure 16:
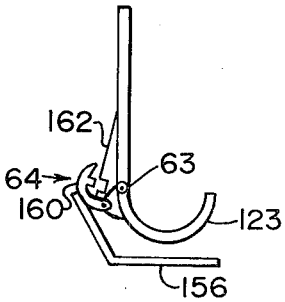

In the embodiment of FIG. 16, co-acting latch means 160, 162, engage each other with the movable latch member 160 being hinged to the trough means 123. When the trough is set down, the underlying arm 156 causes member 160 to be pivoted about the illustrated journal, thereby releasing the latch member 160 from the stationary latch member 162.

Figure 17:
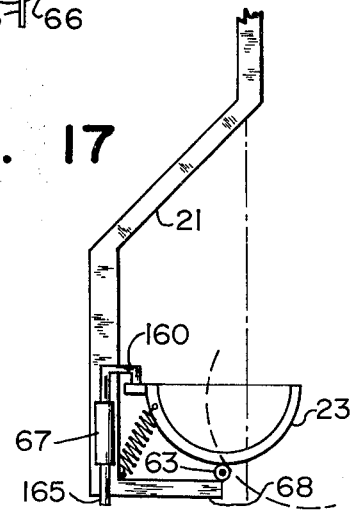
FIG. 17 sets forth another modification of the trough seen disclosed in some of the foregoing figures.

Looking now to the details of FIG. 17, the trough 23 is provided with spaced hinges 63 so that the trough can be rotated about the pipe into the illustrated dot-dash position, thereby dumping the pipe from the trough. Latch 160 is telescopingly received in a reciprocating manner through guide means 67, with end portion 165 underlying the horizontal trough carrying member 68 so that when the trough is set down, member 165 moves member 160 into the illustrated position of FIG. 18 to cause the trough to be released so that the force of gravity causes the trough to pivot about the pipe while the pipe roll from the trough. It will be noted that the center of gravity of the trough is located outwardly of the journal 63.

Figure 18:
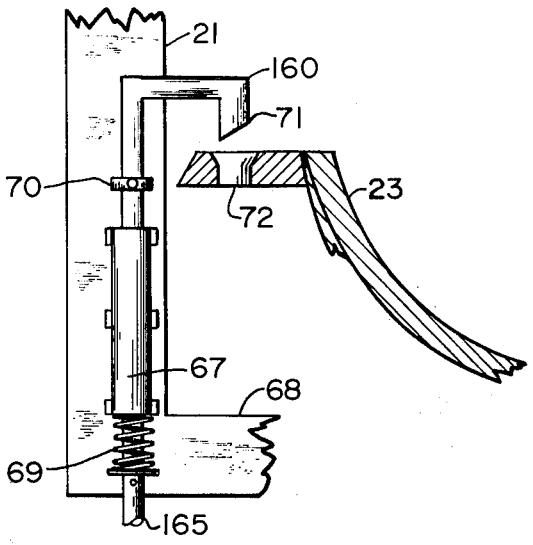
FIG. 18 is a fragmentary, part cross-sectional view which discloses the details of part of the apparatus seen in FIG. 17.

In FIG. 18, wherein the details of the latch means are illustrated, spring 69 is compressibly interposed between the guide and a washer, and pinned to the trip member 165, so as to bias the trip member in a downward direction. Washer 70, welded to the trip member, provides a stop means in cooperation with an uppermost extremity of member 67. Pin 71 releasibly engages the aperture in lug 72 of the trough. Member 71 and 72 are provided with the illustrated co-acting slopped edge portion so that when the illustrated spring returns the trough to the illustrated position seen in FIG. 17, the slopped portions of the members 71, 72, will force the trip member in an upward direction so that it can move into engagement with the pin receiving aperture.

Figure 11C:
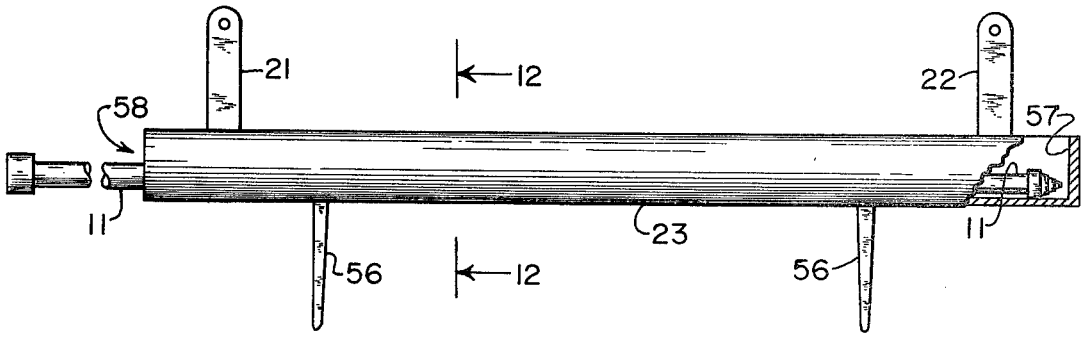
FIG. 11*c* discloses a side elevational view of drawing FIGS. 12–14.
Figure 12:
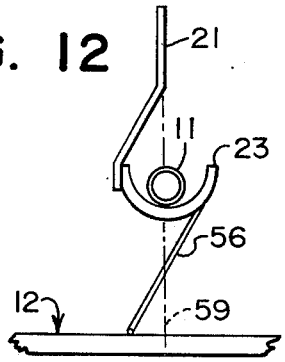
FIGS. 12 to 14 are rear elevational views diagrammatically showing the operation of the apparatus seen in FIG. 11*c;*
Figure 13:
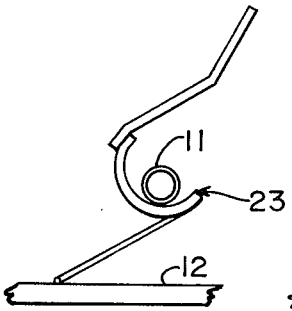
Figure 14:
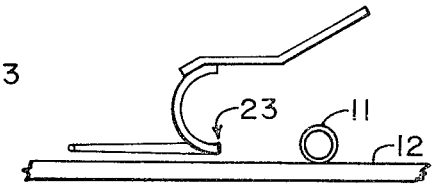
Figure 19:
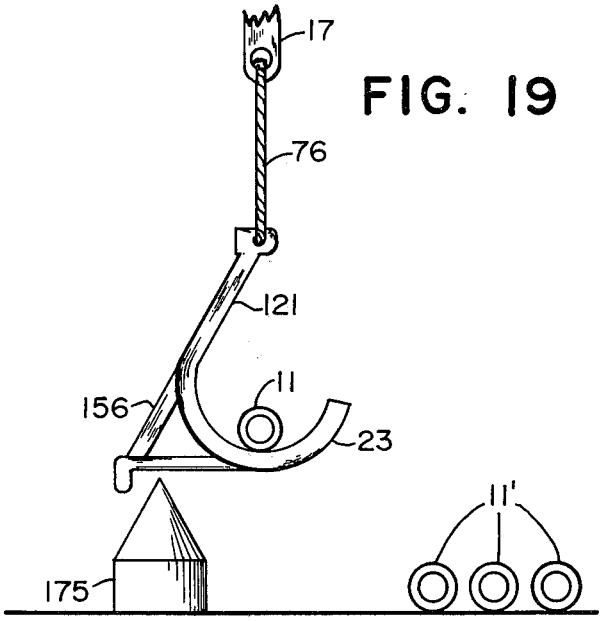
FIG. 19 is a front view of a modification of the apparatus seen in FIGS. 11*a*–14.

In FIG. 19, which is similar in many respects to the embodiment disclosed in FIG. 11*a*, the trough 23 has structure 156 depending horizontally from the same side of the trough to which the hanger 121 is attached, so that when the trough is set down upon a trough engaging member 175, the member 156 will engage the trough and the latter will be rotated about the pipe 11. This section causes the pipe to roll therefrom because of the force of gravity. Flexible member 76 can be a chain or a wire rope.

Figure 20:
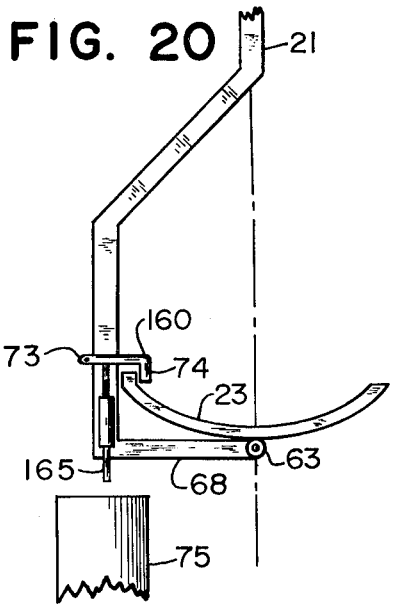
FIG. 20 is a front view of a modification of the apparatus of FIGS. 15 and 16.

FIG. 20 sets forth a modification of FIG. 17, wherein there is illustrated a hinge 63 centrally located relative to the trough, with the trough having an edge portion which releasibly engages latch member 74. The latch member is journaled at 73 to hanger 21, while trip member 165 is abuttingly received by a marginal intermediate portion of the latch member.

Figure 21:
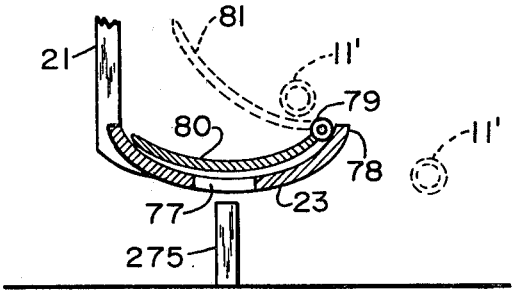
FIG. 21 is a front view of still another modification of the apparatus of FIGS. 15 and 18.

In the embodiment of FIG. 21, the trough means includes a support member 23 which is provided with hole means 77. The trough support member 23 is journaled at edge portion 78 to the pipe engaging trough member 80 by means of a hinge 79. Member 80 forms part of and is pivoted to the trough means by the before mentioned hinge, so that the last mentioned member, when engaged by stationary member 275, is rotated into the illustrated dot-dash position indicated by numeral 81. The action of the moving pipe is illustrated by numerals 11′ and 11″.

Figure 22:
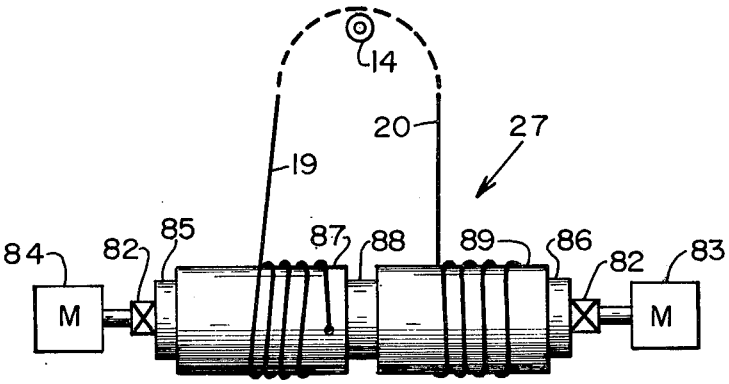
FIG. 22 is a diagrammatical presentation of another embodiment of the apparatus disclosed in either of FIG. 1 or 5.

Looking now to the details of FIG. 22, which illustrates another embodiment of the endless cable drum, there is seen the beforementioned pulley 14 about which cable lengths 19 and 20 are rove. Spaced journals 82 rotatably support a shaft which is driven by spaced reversible hydraulic motors 83 and 84. A brake, achematically illustrated by numerals 85 and 86, engage cable drums 87 and 89, with the drums optionally being interconnected by any interlocking means such as clutch 88. As illustrated in the drawings, the cable lengths 19, and 20, are rove several turns about the spaced drums and preferably have the depending free ends thereof attached to the respective drums. The apparatus of FIG. 22 can be used to advantage in providing means by which the pilot cable or the endless cable can be moved longitudinally of itself.

In operation of the embodiments of FIGS. 1–4, an endless cable is rove between two pulleys 14 and 15, with one of the pulleys being connected to a prime mover and functioning as a cable drum so that portions 19 and 20 of the cable length can be moved longitudinally along its length in a resulting manner wherein the cable 19 travels in an opposite direction relative to the cable 20. The term "endless cable" is intended to mean a cable having the ends thereof attached to one or more cable drums in any suitable and convenient manner, and with the intermediate portion of the cable being turned 180° and supported by one or more pulleys so that a limited length of at least one portion 19 of the cable can be disposed in overhanging relationship with respect to a first and second location 12 and 11. The free ends of the cable can be attached to each other or to the drum, as desired.

The cable engaging members 17 and 18 are each firmly anchored to the cable 19. Accordingly, by imparting rotational motion into the drum 15, each of the cable engaging members will move with the cable carrying the trough therewith.

Hydraulic cylinder 16 moves drum 15 into the alternate position 15' to thereby enable the cable 19 to be lowered into the dot-dashed position 19'. This action places the trough in close proximity to a pipe rack 12'. Hence, those skilled in the art will now appreciate that cable 19 can be slackened so as to enable a pipe joint to be placed within the pipe receiving trough, whereupon the cable is then tightened, the drum energized, and the pipe transported towards pulley 14.

The apparatus of FIG. 1 has the advantage of rapid vertical movement of the carriage for a limited motion of the hydraulic cylinder. The apparatus of FIGS. 2 and 3 have the advantage of there being two cables disposed in side by side relationship and supporting the pipe receiving trough. This last expedient adds stability into the system inasmuch as two spaced apart members are supporting the pipe engaging members, and additionally has the advantage of two cables being made available for supporting the tubular goods.

In coming out of the hole, the pipe is vertically lifted by the elevators until the lower end thereof can be pushed over the roller 50 and the pin end placed within the uppermost end of the trough. The pipe is caused to continue to slide into the trough until it assumes the position seen in the illustration of FIG. 11*a*. The endless cable is then moved until the pipe is transported into an overhanging position relative to the pipe rack, whereupon the hydraulic cylinder 30 is actuated so as to vertically lower the trough until the pipe is received upon the pipe rack.

The trough, now being free of the pipe, is vertically raised and then returned to the derrick floor by first increasing the tension in the cable so as to return the cable to an elevated position and thereafter moving the endless cable along its longitudinal length. It is sometime convenient to have a means by which the trough can be held in close proximity of the roller 50 until a pipe is placed therewithin. Accordingly, the latch means 58 of FIG. 9 of the above mentioned patent can be employed to maintain the uppermost end of the trough in proximity of the derrick floor, if desired.

When going into or coming out of the hole with tubular goods, it is sometime convenient to supplement the apparatus by providing a stop means to position the trough as seen in the illustrated manner of FIG. 7. Accordingly, an abutment can be placed on the cable 19 where deemed desirable.

As noted in applicant's copending case, the powered drum can be placed either in the illustrated position of FIGS. 2–4 or alternatively, the drum can be located on the derrick floor. The various pipe unloading apparatus of FIGS. 11–21 can be used in conjunction with the apparatus disclosed in FIGS. 1–4. The apparatus of FIGS. 8–10 and 22 can also be used to advantage in conjunction with the endless cable apparatus disclosed in FIGS. 1–4.

In using the embodiments of FIGS. 5–7 for transporting pipe from the pipe rack upwardly to the derrick floor, drum 115 of FIGS. 5–7 relieves the tension in the main cable so as to enable the trough to vertically descend into the indicated dot-dashed position illustrated in FIG. 7. The pipe is placed or otherwise delivered or rolled into the pipe receiving portion of the trough and the cable is tightened by energizing its associate drums, whereupon the pipe and trough assumes an elevated position as seen in either of FIG. 6 or 7.

As cable 20 or 120 is tightened, it assumes an inclined position and the weight of the pipe together with the trough tend to move the assembly on its respective low friction bearing towards the stop means. In order to control the longitudinal movement of the pipe with respect to the main cable, the pilot cable 40 is tightened by energizing the drum arrangement generally indicated at 35. This action causes the pipe and trough to be moved by the carriages into the illustrated position of FIG. 8. As the pipe approaches the vertical support member of FIG. 8, roller 52 of the hydraulic ram is moved into contact therewith so as to enable the end of the pipe to be lifted clear of roller 50. The elevators are next placed upon the box end of the pipe and the pipe is then lifted by the elevator into the vertical position above the turntable of the rig where it is axially aligned with the borehole and accordingly can be lowered into the borehole. As the pipe is lifted from the trough, it is unnecessary to provide any additional support for the remaining free end of the pipe which may otherwise be required in order to prevent damage to the pin thereof, because the pin end can freely slide along the bottom of the trough. Once the center of gravity of the pipe has "broke over" the tapered roller, the presence of the trough is no longer required for support of the lower end of the pipe. Accordingly, after the pipe clears the trough, it can travel by gravity back into an overhanging position relative to the pipe rack in order to properly receive the next joint of pipe within the pipe receiving trough. Positioning of the trough relative to the pipe rack is accomplished by the illustrated stop means 122 located adjacent to the lower or truck end of the main cable.

The tension in cable 20 is relieved by rotation of drum 28 whereupon the trough descends vertically towards the pipe rack and another joint of pipe is placed within the pipe receiving portion of the trough, with the operation being repeated until perhaps several hundred joints of drill pipe or casing has been delivered to the derrick floor.

Since the pilot cables 40, 43 must generally follow the curve 20' of cable 20, it is necessary to maintain the tension of the pilot cable proportional to the tension of the main cable by relative rotation of the adjacent drums at 35 and 36. This is best accomplished by a clutch which jointly engages the two drums so as to enable the drums to be controlled jointly or separately, in the illustrated manner of FIG. 22. As cable 20 is lowered, the clutch is disengaged to permit relative rotation between the drums 35 and 36, which enables the pilot cable to be lengthened as required. When the cable 20 is raised, rotation of one drum relative to the other will tighten the pilot cable. It is, of course, satisfactory to employ separate drums, each of which are powered by separate hydraulic motors, so that one drum can operate independent of the other.

In order to permit the trough to return to the pipe rack, it is merely necessary to release the drum controlling the tension in pilot cable 39 so as to enable gravity to cause the trough to travel back down the main cable and into the desired position above the pipe rack.

In coming out of the hole with drill pipe, production pipe, and the like, the before described operation must be reversed and slightly modified. Assuming the elevators have picked up a joint of pipe, a workman moves the pin end of the pipe past roller 50 towards the truck and the elevators are then lowered until the pin is received within the pipe receiving portion of the trough.

With the pin of the pipe supported by a portion of the trough, the elevators are further lowered with the pipe rolling down tapered roller 50 until the box falls off the roller, past run 52, where the box must now fall into or be received by the pipe receiving trough. A marginal free end portion of the pipe freely depends from the trough in the illustrated manner of FIG. 11. The pilot cable is now employed to lower the trough towards the truck, until the lowermost end of the trough abuts the stop means. Cable 20 is then slackened into the dot-dashed position of FIG. 7, whereupon the pipe engaging portion of the trough is disengaged from the pipe, enabling the pipe to roll away from the trough in the illustrated manner of FIGS. 12–14 or 21. The main cable is now tightened, the trough moved by means of drum arrangement 30 back into a position where it is ready to receive the next joint of pipe.

In the operation of FIG. 11*a*, a secondary cable drum 90 has a cable 91 rove thereabout and to a pulley 92 located on the rear carriage 318. The rear carriage may be affixed to the main cable in the manner of either FIG. 1 or 5. Member 22 of the trough is suspended from the carriage by means of wire rope 76. When drum 90 imparts sufficient tension into the secondary cable, the trough assumes an elevated position such as indicated by the dot-dash line 23'. This expedient enables adjustment to be made to the inclination of the trough as it passes through the "V" door of the rig platform.

In FIG. 11*b*, pipes 11 individually roll down the inclined rack surface 12' and into the trough. The trough is received and bottom supported within the illustrated elongate hollow member 93, which must be slightly longer than the length of the trough. Rack portion 94 is journaled to a pipe receiving and delivering member 95 so that when a pipe is placed on member 95, hydraulic cylinder 97 will force crank 98 into the illustrated position. This expedient enables pipe which has been racked on the wrong side of the trough to be rolled from a rack adjacent to member 95, across the hollow member, and onto the rack 12'. Of course, a runner must be placed across the hollow member and the trough must be clear of the apparatus so as to enable the pipe to be rolled thereacross. Aperture 99 receives the piston of cylinder 97' therethrough so as to provide a stop means for the pipe at 11.

The means 275 of FIG. 21 cooperates with the hole means 77 formed through the support member 23 to engage and operate the trough member 80 connected along one edge 78 to the support member 23 which in turn is connected to arm means 21.

Those skilled in the art, having studied the drawings together with the above descriptive portions of the specification, will realize that the pipe receiving portion of the trough disclosed in FIGS. 11*a*–21 can either pick up or deliver the pipe at either location by either controlling the tension of the cable at the pipe rack or by the use of the optional hydraulic ram at the derrick floor.

I claim:

1. Apparatus for transporting pipe from a derrick floor to a pipe rack, and vice versa, comprising:

a main cable, a cable support, a cable drum, means mounting said drum in spaced-apart relationship with respect to said cable support; said cable being rove about the drum so as to enable a marginal length of the cable to be moved vertically relative to a pipe rack placed therebelow when the cable tension is changed;

said means mounting said drum and said support being located such that said cable can be arranged with at least an intermediate portion thereof disposed in overlying relationship with respect to a pipe rack and in close proximity of a derrick floor;

a pair of rigid arms, a pipe receiving, upwardly opening trough means supported by said pair of rigid arms such that said trough means graviates to an upright position; means by which said pair of arms is supported by said cable such that said trough means is movable with respect to the support and the drum;

said trough means includes a trough member which overlies a trough support means, said trough member has opposed, longitudinally extending wall portions, a hole means formed in said trough support means;

means pivotally connecting one of said wall portions of said trough member to said trough support means, said trough support means being affixed to said pair of rigid arms such that said trough member can be rotated respective to said arms from an upright, pipe receiving position into a pivoted, pipe discharging position;

means connected to apply an upward force to said trough member at a location spaced from the pivotal connection thereof such that when said main cable is slackened and while said trough means is being lowered, the downward motion of said trough means causes the trough member to pivot from an upright into a pipe discharging configuration, thereby causing a pipe which may be supported within said trough member to roll by gravity therefrom;

said means connected to apply an upward force cooperates with said hole means to engage and operate the trough member at a location spaced from each longitudinally extending side of the trough member so that as the trough means is set down, the trough member is forced to pivot about one edge and thereby move in an upward direction respective to the arms which support the trough means, thereby forcing the trough member to pivot into the pipe discharging position;

and when said cable is tightened, said trough means is lifted by said arms and said trough member is forced by gravity to pivot into the pipe receiving position.

* * * * *